United States Patent [19]

Williamson

[11] 3,936,620

[45] Feb. 3, 1976

[54] UNIDIRECTIONAL LIMIT SWITCH ACTUATOR ELEMENT

[75] Inventor: Bobby J. Williamson, Greenville, S.C.

[73] Assignee: Southern Machinery Company, Greer, S.C.

[22] Filed: Apr. 10, 1974

[21] Appl. No.: 459,613

[52] U.S. Cl. ..... 200/47; 57/54

[51] Int. Cl.[2] ..... H01H 3/16

[58] Field of Search ..... 200/47, 338, 339, 330, 200/337, 153 T, 61.41, 61.42, 160

[56] References Cited

UNITED STATES PATENTS

| | | | |
|---|---|---|---|
| 2,533,040 | 12/1950 | Petrak | 200/47 |
| 3,803,824 | 4/1974 | Williamson et al. | 57/54 |

*Primary Examiner*—James R. Scott
*Assistant Examiner*—M. Ginsburg
*Attorney, Agent, or Firm*—B. P. Fishburne, Jr.

[57] ABSTRACT

The utility and range of application of conventional electrical limit switches is greatly increased by the provision on the pivoted switch actuating arm or lever of a unidirectional actuator attachment. The attachment element is pivoted to the arm and cooperates with a stop lug on the arm to render the element active for moving the switch actuator arm in response to engagement of the element by an object moving in one direction relative to the element. When the element is engaged by an object moving in the opposite direction, it yields relative to the arm and is incapable of moving the arm to actuate the switch. In an alternate operating mode, the attachment element may be rendered rigid with the switch arm to form an effective extension thereof.

5 Claims, 3 Drawing Figures

UNIDIRECTIONAL LIMIT SWITCH ACTUATOR ELEMENT

BACKGROUND OF THE INVENTION

There are numerous applications of electrical limit switches on machinery having moving components. It is customary to mount a limit switch or switches adjustably relative to moving machine carriages or like parts whose extent of movement, stopping or reversal of movement, must be accurately regulated.

A typical application of electrical limit switches is disclosed in United States application S.N. 273,866, filed July 21, 1972, now U.S. Pat. No. 3,803,824, issued Apr. 16, 1974. In this patent a mechanical spinning frame ring rail lowering mechanism is disclosed consisting of a mechanical clutch and pulley arrangement, whereby activation of the clutch at a certain time during the winding of textile bobbins will cause the ring rail to be lowered to a bobbin doffing position and held in such position prior to the next bobbin building cycle of operation.

In conjunction with the clutch unit, a clutch-activating or trip mechanism is bodily mounted on the ring rail to move therewith and the purpose of the trip mechanism is to cause the release at the proper time of a spring-loaded linkage which is connected to a rotary activating tab of the clutch, whereby release of the linkage by the trip mechanism will allow the linkage to activate the clutch for lowering the ring rail. More particularly, the coasting inertia of the spining frame is employed, following the activation of the clutch to effect the lowering of the ring rail, the spinning frame motor being de-activated according to one disclosed mode of operation when the linkage is released by the trip mechanism.

As disclosed in said patent, the trip mechanism on the oscillating ring rail includes a release finger which engages the linkage on the next-to-last upstroke of the ring rail to cause the release of a trip element, which on the final upstroke of the ring rail engages and releases the clutch activating linkage.

The patented system discloses two alternate modes of operation, the first of which involves a single switch to shut off the spinning frame motor as the ring rail lowering clutch unit is activated. This mode depends upon the coasting of the frame to completely lower the ring rail. In the alternate mode of operation, two separate switches are employed and the spinning frame motor is not shut off until both electrical switches have been operated.

While the present invention has an almost limitless range of utility in connection with machinery, it is ideally suited for use in the system covered by the above-mentioned patent and therefore will be disclosed in connection therewith. It should be understood, however, that the invention is in no sense limited to this particular use or application.

BRIEF DESCRIPTION OF DRAWING FIGURES

DETAILED DESCRIPTION

Figure 1:
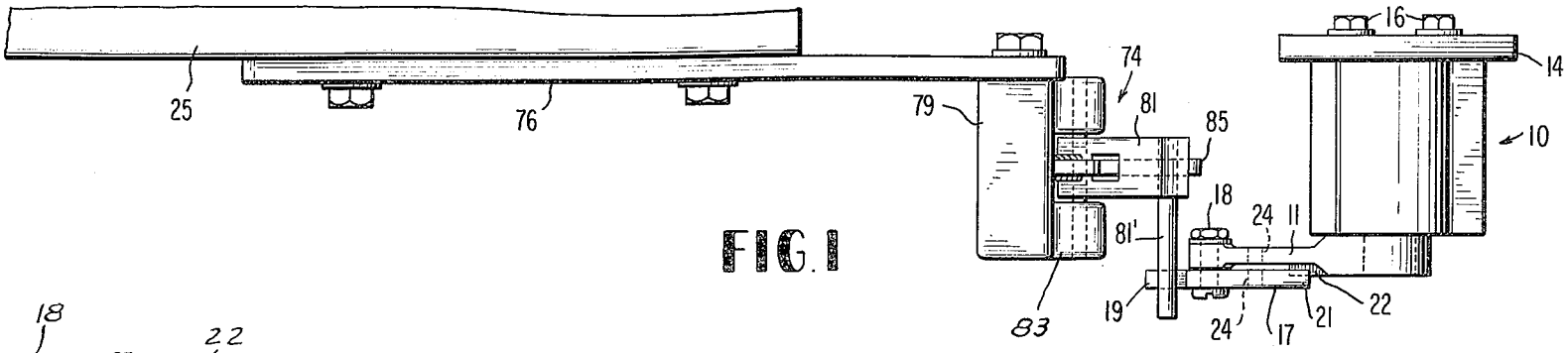
FIG. 1 is a fragmentary plan view of the invention shown in conjunction with the ring rail of a spinning frame and associated trip mechanism.

The disclosure of U.S. Pat. No. 3,803,824 is hereby incorporated by reference into this application in order to simplify the application.

Referring to the application drawings in detail, wherein like numerals are employed to designate like parts, reference is made first to certain parts which are disclosed in the abovementioned patent, the same reference numerals employed in the patent being employed herein for convenience of reference.

The numeral 25 designates the movable ring rail of a spinning frame which oscillates in a vertical path in a well known manner during the bobbin building process. When the building of the bobbins is completed, it is customary to lower the ring rail to a bobbin doffing position, either manually or by power-operated means such as employed in said patent.

Adjustably mounted on the ring rail 25 to move therewith is a bracket or mounting plate 76 having a trip mechanism housing 79 rigidly and adjustably secured thereto. Pivoted to an extension 83 of the housing 79 at 82 is a trip element 81. A roll pin 81', not disclosed in said patent, is secured to the trip element 81 near its top and projects horizontally beyond one side thereof for an important purpose to be described. The trip element 81 is biased toward its position shown in full lines in the drawings by a spring 84 and is held at certain times in the retracted upright or inactive position shown in broken lines by a release finger 85 pivoted at 86 to the housing 79 and biased to a level locking position in relation to a locking shoulder 88 by another spring 89. These described elements are components of the trip mechanism 74 fully described in the above-mentioned patent and it is thought that no further description of the trip mechanism per se is required herein for a full understanding of the invention.

Figure 2:
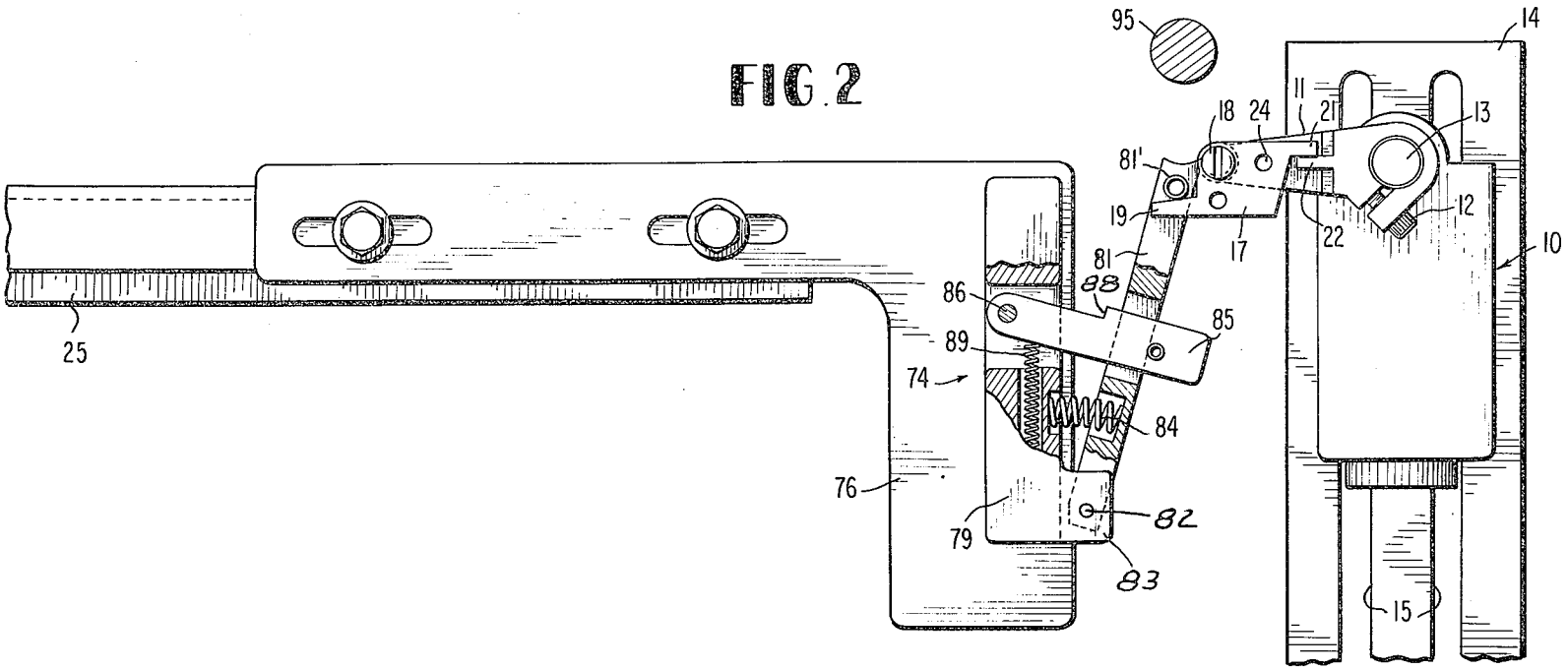
FIG. 2 is a fragmentary side elevation of the invention as depicted in FIG. 1, parts in section.
Figure 3:
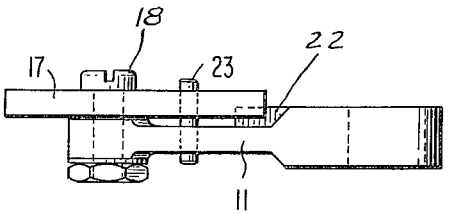
FIG. 3 is a fragmentary plan view of the invention according to a modification thereof.

In FIG. 2 of the application drawings, a rod 95 is shown in its proper relationship to the invention and trip mechanism 74 and this rod forms a part of the clutch release linkage shown particularly in FIGS. 3 and 3A of the mentioned patent.

Referring now to components which are not disclosed in said patent but which form a part of the invention, the numeral 10 designates a limit switch of any well-known type, such as a limit switch manufactured and sold by Square D Company, Milwaukee, Wisconsin, as Class 9007, Type B51-B2, or the like. The limit switch 10 has an actuator arm or lever 11 secured by a clamping screw 12 to a switch rotor shaft 13. Limit switches of this type may be arranged to operate by movement of the arm 11 in one direction or in opposite directions from a neutral position such as shown in the drawings, the arm being spring-biased to the neutral position.

When used in conjunction with the ring rail lowering mechanism of said patent, the switch 10 is vertically adjustably mounted on a fixed bracket 14 which may be attached to either the fixed spindle rail 20 or roll beam 101 in said patent. Vertical adjustment and positioning of the switch 10 is accomplished by the use of vertical adjustment slots 15 provided in the bracket 14 and suitable locking screws 16.

The unidirectional switch actuator attachment element constituting the essence of the invention is designated by the numeral 17 and is a small plate element adapted to swing in a vertical plane relative to the arm 11 around the axis of a pivot element 18, by means of which it is pivotally attached to the free end of the actuator arm 11. At its leading end, the unidirectional switch actuator element 17 has a tapered contact extension 19 in the path of movement of the roll pin 81', as will be further described. In the position shown in FIG. 2, the contact extension 19 is forwardly of and below the level of pivot element 18.

At its rear end, the element 17 carries a stop extension 21 adapted to contact a fixed stop lug 22 which is cast on one side of the actuator arm 11. The stop extension 21, as shown in FIG. 2, is slightly above pivot element 18 and spaced rearwardly thereof. The body portion of the pivoted unidirectional actuator element 17 is eccentrically weighted relative to pivot element 18 to assume the position shown in FIG. 2 under the influence of gravity where the elements 21 and 22 are in engagement. If the extension 19 is depressed as by downward movement of the roll pin 81' to rotate the element 17 counter-clockwise on its pivot, such element will be gravity-returned to the illustrated position in FIG. 2 after the roll pin 81' passes or trips over extension 19.

As will be further described, the element 17 may also be made to serve as a rigid extension on the actuator arm 11 in some cases rather than a pivoted unidirectional or one-way active element. In such cases, another roll pin 23, FIG. 3, may be assembled through registering openings 24 in the arm 11 and element 17.

When the described invention is employed with the apparatus of the referenced prior patent, and assuming the absence of the locking roll pin 23 so that the attachment actuator element 17 is free to pivot on the arm 11 of the switch, the following cycle of operation will occur. On the next-to-last upstroke of the ring rail 25, the release finger 85 will contact the rod 95 and release the trip element 81 to the active position shown in full lines. As the ring rail descends prior to the final upstroke thereof, the projecting roll pin 81' will trip over the extension 19 causing the element 17 to pivot counter-clockwise and return by gravity to the position shown with the elements 21 and 22 in positive contact. Thus, the element 17 is inactive and produces no switch activation on the final downward movement of the ring rail. However, on the final upstroke of the ring rail, roll pin 81' will engage the bottom of extension 19 tending to rotate the attachment element 17 on its pivot 18. The contacting stop elements 21 and 22 will prevent this and consequently the entire arm 11 will turn clockwise on the axis of switch rotor shaft 13 to open the switch. This means that during the final upstroke of the ring rail 25, power to the spinning frame motor will be cut off first by opening of the switch 10, followed by engagement of trip element 81 with the bottom of rod 95 to release the clutch linkage and activate the clutch, in the manner disclosed in the prior patent. Once the clutch is rendered active, the ring rail will be lowered to the bobbin doffing position by the coasting inertia of the frame.

In an alternate mode of operation where the particular spinning frame has a shorter coasting cycle than is available with the mode of operation described immediately above, the roll pin 23, FIG. 3, is utilized to render the element 17 rigid with the switch actuator arm 11. In this case, power to the spinning frame will not be cut off until after the linkage rod 95 is released by the trip element 81 on the final upstroke of the ring rail. That is to say, as the ring rail is being lowered under power by the clutch mechanism, and when the roll pin 81' engages the top of extension 19, the switch 10 will be opened to then shut off power to the spinning frame motor because the element 17 cannot yield and pivot independently of the arm 11 but can only serve to depress the arm 11 and open the switch, the latter being of the type which is opened by movement of the arm 11 in either direction from the neutral position shown in the drawings.

It has been shown that the provision of the unidirectional or one-way active element 17 on the limit switch actuating arm 11 enables a single switch to be utilized in two different operational modes in conjunction with the ring rail lowering clutch mechanism of the referenced patent, in lieu of two separate switches shown in this patent for carrying out the necessary modes of operation with spinning frames having longer or shorter coast cycles. Similarly, the attachment element 17 increases the utility of the switch 10 in a variety of similar machinery applications where a moving element of the machine is utilized to trip or activate a limit switch. In some instances, the one-way active attachment element 17 will enable one limit switch to do the work of two switches or will make possible a mode of operation which is not attainable where the moving machine element trips the switch arm 11 in both directions rather than unidirectional. It is thought that the utility of the invention has now been adequately described in connection with a single application so that those skilled in the art can easily envision numerous additional applications of the invention.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a limit switch or the like having a rotary switch actuator arm adapted to extend toward the path of movement of a reciprocating machine element, the improvement which comprises a one way engaging and one way inactive switch actuator arm extension freely pivotally secured to the actuator arm and extending on opposite sides of its pivot axis and longitudinally of said arm, the center of mass of said arm extension being eccentric to said pivot axis whereby the extension is weighted to an engaging position in response to gravity, said switch actuator arm having an abutment thereon, a first end terminal on the weighted portion of said extension engaging said abutment under the influence of gravity and being free to separate from the abutment on pivoting of the extension in one direction, and a second end terminal on the other end of said extension and on the opposite side of said pivot axis and projecting into the path of movement of a machine element to be engaged thereby, engagement of the second end terminal by said machine element moving in one direction causing throwing of the limit switch due to engagement of the first end terminal with said abutment and engagement of the second end terminal by said machine element moving in the opposite direction causing pivoting and yielding of the extension on its pivot and separation of the first end terminal from said abutment without throwing of the limit switch.

2. The structure as defined by claim 1, and said switch actuator arm extension having a plate body portion with said first end terminal projecting outwardly from one upper corner of the plate body portion and the second end terminal projecting oppositely from the diagonally opposite lower corner of the body portion, the pivot for the extension being disposed between the first and second end terminals and near the top of the plate body portion.

3. The structure as defined by claim 1, and means to positively lock the actuator arm extension when desired against pivotal movement in either direction on the switch actuator arm.

4. The structure as defined by claim 3, and said means comprising registering apertures in the switch actuator arm and arm extension, and a locking pin element insertable through said apertures.

5. Means for converting a bidirectional limit switch to a unidirectional switch, said limit switch having a rotary actuator arm including an abutment element, said means comprising an eccentrically weighted switch actuator arm extension freely pivotally secured to one side of the actuator arm and biased by gravity thereon in one direction, a first end terminal carried by the gravity biased end of the pivoted extension and normally in positive engagement with said abutment element of the actuator arm and freely separable therefrom when said extension is turned on its pivot in one direction, and a second end terminal on the opposite end of the pivoted extension and on the side of the pivot point of the extension remote from the first end terminal and adapted to be engaged by a reciprocating machine element, such engagement in one direction of movement of the machine element causing throwing of the switch due to engagement of said abutment element and first end terminal, and engagement in the opposite direction of movement of the machine element causing free pivoting of said extension and separation of the first end terminal from the abutment element without throwing the switch.

* * * * *